US009605421B2

(12) United States Patent
Wu et al.

(10) Patent No.: US 9,605,421 B2
(45) Date of Patent: Mar. 28, 2017

(54) WATER-SAVING SIPHON TOILET

(71) Applicant: Feiyu Li, Xiamen, Fujian (CN)

(72) Inventors: Aimin Wu, Xiamen (CN); Haitao Xu, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 866 days.

(21) Appl. No.: 13/899,889

(22) Filed: May 22, 2013

(65) Prior Publication Data

US 2013/0312173 A1 Nov. 28, 2013

(30) Foreign Application Priority Data

May 23, 2012 (CN) ..... 2012 1 0162936
Jul. 31, 2012 (CN) ..... 2012 2 0376925 U

(51) Int. Cl.

| | |
|---|---|
| ***E03D 11/02*** | (2006.01) |
| ***E03D 11/18*** | (2006.01) |
| ***E03D 11/08*** | (2006.01) |
| ***E03D 1/26*** | (2006.01) |

(52) U.S. Cl.
CPC ..... *E03D 11/18* (2013.01); *E03D 1/26* (2013.01); *E03D 11/08* (2013.01)

(58) Field of Classification Search
USPC ..... 4/422, 421
See application file for complete search history.

(56) References Cited

U.S. PATENT DOCUMENTS

| | | | | |
|---|---|---|---|---|
| 6,279,176 | B1 * | 8/2001 | Aviles | E03D 1/286 4/354 |
| 6,823,535 | B2 * | 11/2004 | Tomita | E03D 3/00 4/421 |
| 2010/0043130 | A1 * | 2/2010 | Grover | E03D 11/08 4/324 |
| 2010/0125940 | A1 * | 5/2010 | Sigler | E03D 11/18 4/432 |

* cited by examiner

*Primary Examiner* — Lauren Crane
(74) *Attorney, Agent, or Firm* — Rabin & Berdo, P.C.

(57) ABSTRACT

A water-saving siphon toilet has a toilet body and a water tank, a eject water channel used for flushing the bottom of the toilet body and a brushing water channel used for brushing the washable surface of the toilet body are arranged between the toilet body and the water tank, and a siphon channel used for pollution is arranged at the bottom of the toilet body, and a first drain valve and a overflow pipe are arranged in the water tank, the eject water channel is isolated from the outside air, and reserved water is stored in the eject water channel for assisting flush the bottom of the toilet body next time. The eject water channel of the toilet body contacts outside air only at the water seal out of the eject hole when the toilet is at non-working states.

4 Claims, 7 Drawing Sheets

WATER-SAVING SIPHON TOILET

FIELD OF THE INVENTION

The present invention relates to a bathroom production, more particularly to a water-saving siphon toilet.

BACKGROUND OF THE INVENTION

As shown in FIG. 1, the eject siphon toilet at the prior art is generally provided with two outlet channels, namely the eject water channel 12' and the brushing water channel 14'. Water flow is divided into two parts after coming out of the drain valve of the water tank, one of which is used for washing the inner ring surface of toilet body 10' through the brushing water channel 14', and another one of which is used for washing the bottom of toilet body 10' in a ejecting manner through the eject water channel 12' and helping the siphon channel 30' generate the siphonic effect. Because the brushing water channel 14' is communicated with outside air and the eject hole 7' of the brushing water channel 14' is communicated with the eject opening 6 of the eject water channel 12', the upper end of the brushing water channel 12' is also communicated with the outside air. As shown in FIG. 2, after toilet body 10' is washed by the brushing movement of water flow, water is only stored in the channel part 12.1' under the water seal line 11' of the siphon channel 30', and all the channel part 12.2' that is above the water seal line 11' and below the drain valve of the water tank is provided with air. When water comes out of the drain valve 22', the water flow passing through the eject water channel 12' has to expel the air in the channel part 12.2' of the eject water channel 12', and then enters the siphon channel 30'. Therefore, the siphonic effect above is generated slowly, and part of the water stored in the siphon channel 11' will overflow from the highest point of the S bend 30' of the siphon channel of the toilet during the filling process of the eject water channel 12', so that the water is wasted; at the same time, because the drain valve is opened before the eject water channel is filled, the water level of the water tank is dropped, so that the potential energy of actual flushing is lower than that of the original water level, and water is also wasted unnecessarily.

SUMMARY OF THE INVENTION

To overcome the defect at the prior, a water-saving siphon toilet that can maximum the siphon efficiency is provided in the present invention.

The technical proposal solving the technical matter in the present invention is:

Water-saving siphon toilet, comprises a toilet body and a water tank, a eject water channel used for flushing the bottom of the toilet body and a brushing water channel used for brushing the washable surface of the toilet body are arranged between the toilet body and the water tank, and a siphon channel used for pollution is arranged at the bottom of the toilet body, and drain valves and a overflow pipe are arranged in the water tank, the eject water channel is isolated from the outside air, and the upper end of the outlet of the eject water channel is lower than the height of upper end of the siphon channel for pollution, and reserved water offering the eject power for flushing the bottom of the toilet body next time is stored in the eject water channel above and below the water seal line of the toilet.

In a preferred embodiment, a common channel is arranged between the said brushing water channel and the eject water channel, and an isolating wall is arranged to the common channel, and a check valve is arranged on the isolating wall; the check valve is provided with a first states and a second states, and the first states is that the check valve is opened when the water tank is at draining states, so that water flows through both the eject water channel and the brushing water channel, and the second states is that the check valve is shut when the water tank is at non-draining states, so that the eject water channel and the brushing water channel are hermetically isolated.

Furthermore, the common channel comprises a first common segment in the water tank and a second common segment on the toilet body, and the check valve is arranged on the first or the second segment.

Furthermore, the check valve at least comprises a check valve body and check valve plate, and the entrance ahead the common channel is arranged on the check valve body, and the check valve plate can rotate around one axis or move up and down along one line; when the draining of the water tank is started, water flows from the common channel to the brushing water channel, and the entrance is opened by the check valve plate; the entrance is closed by the check valve plate before the draining is over.

Or, as another preferred embodiment, a second drain valve is also arranged in the water tank; water enters the eject water channel through the second drain valve. And water enters the brushing water channel through the first drain valve, and the overflow pipe is arranged on the first drain valve, and the eject water channel and the brushing water channel are not communicated with each other at non-draining states.

In a preferred embodiment, the eject water channel and the brushing water channel are isolated from each other, and the eject water channel is communicated with the draining outlet of the water tank, and the brushing water channel is communicated with the water tank or other water source independently.

Compared with the technical proposal at the prior, the benefits of the present invention are:

1 the siphon toilet in the present invention, the inlet of the eject water channel is isolated from outside air, and the outlet is below the water seal line of the toilet, and the air pressure in the eject water channel is lower than outside air after the first draining, reserved water offering the eject power for flushing the bottom of the toilet body next time is stored in the eject water channel above and below the water seal line of the toilet under the atmosphere on the water surface.

Therefore, at the following draining of the drain valve, the speed of water flowing through the drain valve is fast and the flushing effect to the bottom of the toilet is better because of the combined action of the outside air pressure, the potential energy in the water tank and the potential energy of the stored water in the eject water channel. At the same time, the reserved water in the eject water channel can act on the siphon channel directly at the next flushing to the bottom of the toilet, and the water stroke is saved, and the flushing effect is greatly enhanced.

2 when water is ejecting out of the eject hole of the bottom of the toilet body through the eject water channel, water flow doesn't need to overcome the air resistance in the eject water channel, and the energy cost of water flow during the flowing process is reduced, and the water waste caused by that the reserved water in the siphon channel overflows during the process that the eject water channel being filled by water can be avoid.

BRIEF DESCRIPTION OF THE DRAWINGS

The drawings provided here are for better understanding of the present invention and is part of the present invention, the schematic embodiments of the present invention and the description of that are used for explaining the present invention, and the improperly limits to the present invention are not generated.

DESCRIPTION OF THE PREFERRED EMBODIMENTS

With the following description of the drawings and specific embodiments, the invention shall be further described in details. It is needed to be understood that the described embodiments here are only used for explaining the present invention but not limiting the present invention.

Embodiment 1

Figure 3:
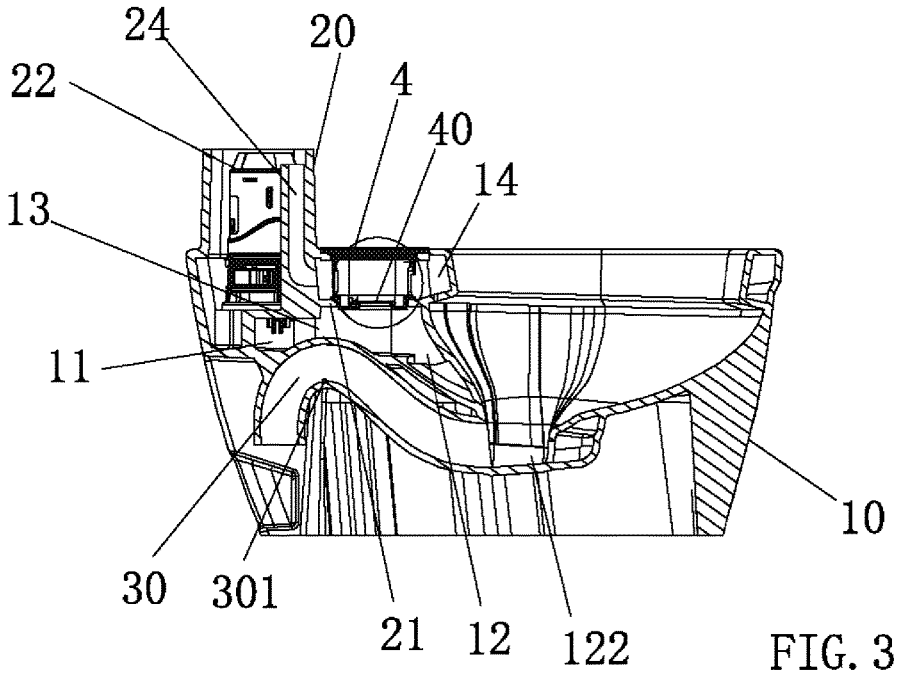
FIG. 3 shows the sectional view of the embodiment 1 of the water-saving siphon toilet in the present invention.
Figure 5:
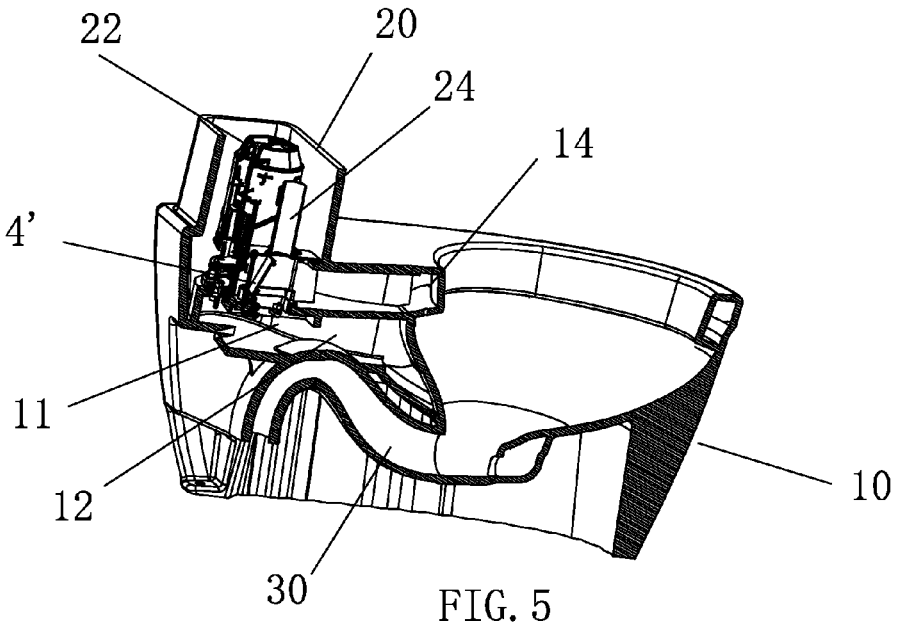
FIG. 5 shows the lengthwise sectional view of the embodiment 2 of the water-saving siphon toilet in the present invention.

As shown in FIG. 3, the water-saving siphon toilet in the present invention comprises a toilet body 10 and a water tank 20, a eject water channel 12 used for flushing the bottom of the toilet body 10 and a brushing water channel 14 used for brushing the washable surface of the toilet body 10 are arranged between the toilet body 10 and the water tank 20, and a siphon channel 30 used for pollution is arranged at the bottom of the toilet body 10, and a first drain valve 22 and a overflow pipe 24 are arranged in the water tank 20 (as shown in FIG. 5); when water flows out of the drain valve 22 of the water tank 20, the toilet body 10 is flushed by water through the eject water channel 12 and the brushing water channel 14; an isolating wall 21 is arranged between the eject water channel 12 and the brushing water channel 14 of the toilet, and a check valve 4 is arranged on the isolating wall 21, and the check valve plate 40 is closed when the draining is over, and then the eject water channel 12 is isolated from outside air the air pressure in the eject water channel 12 is lower than the outside air pressure, therefore offering power reserved water is stored in the eject water channel 12 for flushing the bottom of the toilet body 10 next time because of the outside air pressure. As shown in FIG. 3, a common channel is arranged before place where the eject water channel 12 and the brushing water channel 14 are divided, and water passes the water tank 20 and the common channel in turns, and then is divided to the eject water channel 12 and the brushing water channel 14, and the common channel comprises a first common segment 11 in the water tank 20 and a second common segment 13 on the toilet body 10; wherein, a check valve 40 is arranged on the second segment 13 for isolating the eject water channel 12 and the brushing water channel 14 and making them air-tight seal; the check valve 40 is provided with a first states and a second states, and the first states is that the check valve 40 is opened when the water tank 20 is at draining states, so that water flows through both the eject water channel 12 and the brushing water channel 14, and the second states is that the check valve 40 is shut when the water tank 20 is at non-draining states, so that the eject water channel 12 and the brushing water channel 14 are hermetically isolated.

In the technical proposal above, the brushing water channel 14 is communicated with the outside air. When the drain valve 20 is draining, water flows in the eject water channel 12 and the brushing water channel 14, therefore the remaining air is squeezed out of the eject water channel 12 and the brushing water channel 14; when the draining is done, the eject water channel 12 and the brushing water channel 14 are hermetically isolated by the check valve 40, so that the upper end of the eject water channel 12 cannot be communicated with outside air through the brushing water channel 14; besides, because the overflow point 301 of the S bend of the siphon channel 30 is higher than upper part of the flushing hole 122 at the bottom of the toilet body 10, the lower end of the eject water channel 12 is isolated from outside air by the water seal formed in the siphon channel 30. From the foregoing, the interior of the eject water channel 12 is at vacuum states or essential vacuum states (with a little air), and the air pressure in the eject water channel 12 is lower than the outside air pressure. In this kind of negative pressure states, a lot of reserved water is stored in the eject water channel 12 after one time draining for flushing the bottom of the toilet body 10 next time, and the eject water channel 12 can be filled or nearly filled by the reserved water. Because the eject water channel 12 is nearly filled with water, the water from the drain valve can act on the siphon channel 12 to accelerate the generation of siphon when the drain valve 20 is draining next time, and the water flow does not need to overcome the air resistance in the eject water channel 12, and then the loss of the potential energy of water flow is avoided. So that less water is needed to achieve the same flushing effect and water is saved.

Figure 4:
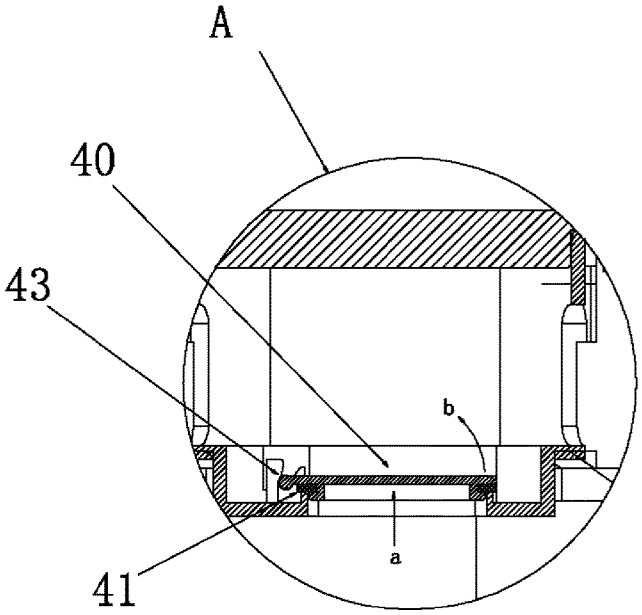
FIG. 4 shows the amplifier view of the FIG. 3A.

The structure of the check valve 4 can be various without limits, such as the rotation type, the clamshell type or lateral moving type. As shown in FIG.3, the clamshell type check valve is present. As shown in FIG.4, the check valve plate 40 is a surface plate structure, two sealing gaskets 41 are arranged to the two ends of surface plate respectively for air-tight seal, and a fixing seat 43 for fixing the check valve plate 40 is arranged at one side of the check valve 4, and another end of the check valve plate 40 is a free end; when water flows along the a direction shown in the figure, the check valve 40 is raised, and one end of the check valve plate 40 is turned along the b direction shown in the figure; when the draining is done, the check valve plate 40 drops downward under the gravity, and the hermetical isolation is achieved again.

To achieve the said isolating from the eject water channel to outside, the overflow and supply channel for the toilet is arranged out of the eject water channel.

Embodiment 2

As shown in FIG. 5, the differences from the embodiment 1 are: the check valve 4 is arranged in the first common segment 11 in the water tank 20. When water flows out of the drain valve 22 of the water tank 20, the check valve 4 is raised by water, and water passes through the eject water channel 12 and the brushing water channel 14 to flush the inner ring surface and the bottom of the toilet body 10. When not draining, the check valve 4 drops downwards under the action of gravity to achieve hermetical isolation. Therefore, the isolation from the eject water channel 12 to outside air can also be achieved.

Embodiment 3

Figure 6:
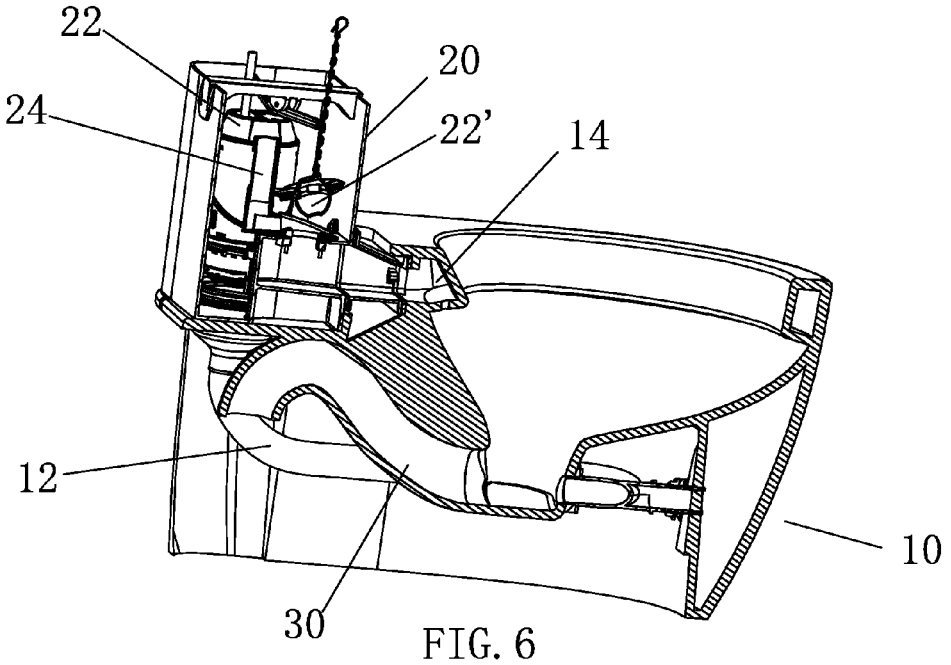
FIG. 6 shows the lengthwise sectional view of the embodiment 3 of the water-saving siphon toilet in the present invention.

As shown in FIG. 6, the differences from the embodiment 1 are: the eject water channel 12 is not communicated with the brushing water channel 14, and are independent to each other, the said common channel in the embodiment 1 and 2 is not present; a second drain valve 22' is also arranged in the water tank 20; water enters the brushing water channel 14 through the first drain valve 22, and the overflow pipe 24 is arranged on the first drain valve 14, and water enters the eject water channel 12 through the second drain valve 22'. In a similar way, the isolation from the eject water channel 12 to the outside air can be achieved.

To achieve the said isolating from the eject water channel to outside, the overflow and supply channel for the toilet is arranged on the first drain valve, and no opening communicating with outside is arranged on the second drain valve.

Embodiment 4

Figure 7:
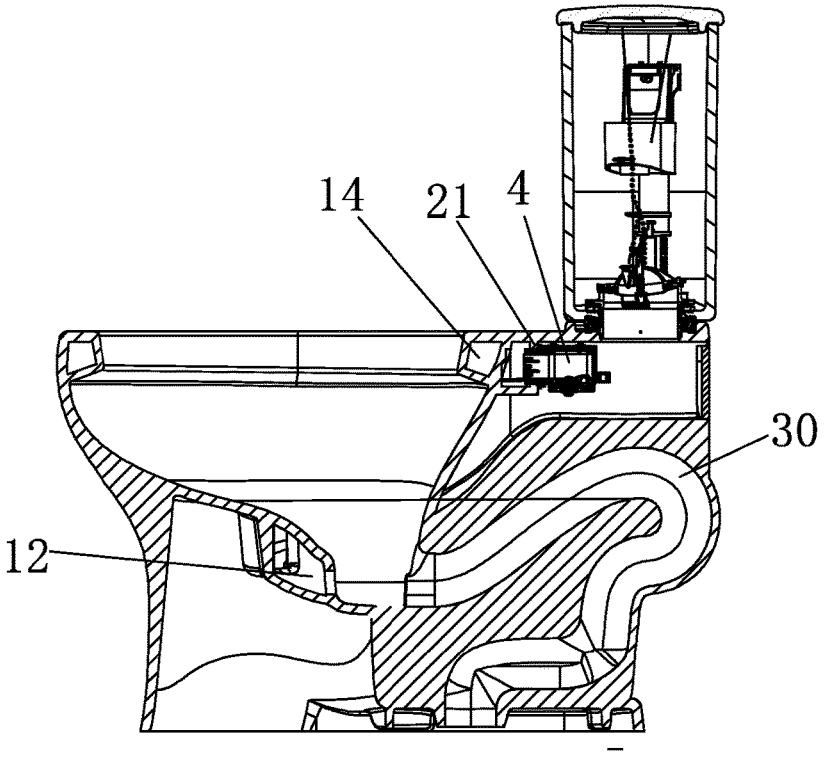
FIG. 7 shows the lengthwise sectional view of the embodiment 4 of the water-saving siphon toilet in the present invention.
Figure 8:
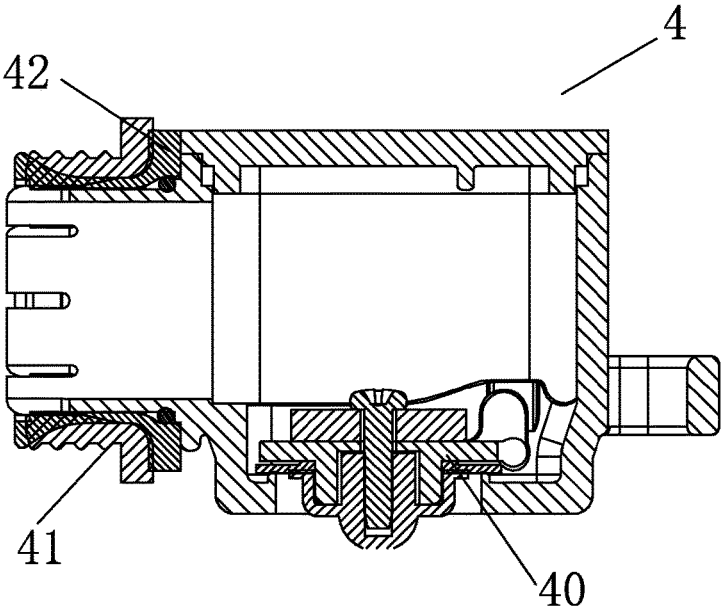
FIG. 8 shows the lengthwise sectional view of the check valve of the embodiment 4 in the present invention.

As shown in FIGS. 7 and 8, the check valve assembly for isolating the common channel and the brushing water channel 14 is arranged at the connecting position of the eject water channel 12 and the brushing water channel 14 (the check valve assembly can be mounted from the drain valve opening of the toilet body). The largest external diameter of the first seal element 41 is designed to be slightly larger than the internal diameter of the hole on the isolating wall 21. And The largest external diameter of the expansion tube 42 is designed to be larger than the smallest internal diameter of the first seal element 42. The first seal element 41 is coupling with the opening of the isolating wall 21 of the toilet body in a tight fitting manner. Then the expansion tube 42 is sleeved in to compress the radial expansion of the first seal element 41. And then the check valve 4 is sleeved in, the expansion tube 42 is pushed by the inclined plane of the check valve 4 to extend outward, and further compress the radial expansion of the first seal element 41 to make it compact to the toilet, and then the common channel of the toilet and the brushing water channel 14 are hermetically isolated at the non-draining states, and outside air cannot enter the common channel from the juncture of the check valve assembly and the ceramic wall. To ensure that outside air cannot enters the common channel, the overflow and supply channel of the water tank 20 is hermetically isolated from the common channel. The check valve 4 is preferably designed to store some water to enhance and ensure the sealing effect of the sealing gasket of the check valve 4. When draining the first time, water from the drain valve enters the common channel. The water pressure that draining-out water generated to the check valve plate 40 is bigger than gravity and the pressure from the reversed water, then the pressure difference generates the forward opening pressure to the check valve 4 and then the check valve 4 is opened. One part of the water in the common channel enters the brushing water channel 14 for brushing the washable surface, one part of that enters the eject water channel 12 for flushing the pollution in the toilet through the eject opening and helping the S bend 30 of the siphon channel form siphon. When the draining is about to end, the forward pressure from water to the check valve 4 is reduced along with the water level dropping, and then the check valve plate 40 is closed under the action of gravity (other force can also be added, such as spring force or magnetic force). The brushing water channel 14 is isolated from the main water channel at this moment, air cannot be transferred to the main water channel through the brushing holes for the washable surface on the brushing water channel 14. After the drain valve is closed, the eject water channel 12 is only communicated with atmosphere through the water seal communicating with the eject opening, other outlets are closed. The whole eject water channel 12 is nearly filled with water under the action of atmosphere. And the eject water channel is not need to be filled with water again after the next time draining. The washable surface can be brushed and the pollution at the bottom of the urinal part can be flushed as soon as the draining is started. Therefore the siphon is early, and its lasting time is long, so that the siphon effect is enhanced, and the water supplying to the washable surface is enough with short water route and enhanced washing effect.

Embodiment 5

As shown in FIGS. 9, 10, 11 and 12, a water-saving siphon toilet comprises a toilet body 10 and a water tank 20, an inlet valve 3, a drain valve 22 and a water overflowing and replenishing mechanism 5 are arranged in the water tank 20; the toilet body 10 comprises a eject hole 6 arranged to the bottom of the urinal part of the toilet body 10 and a flushing opening 7 for flushing the washable surface; and at least one eject water channel 12 communicating with the eject hole 6 and at least one brushing water channel 14 communicating with the flushing opening 7 are arranged on the toilet body 10; and the eject water channel 12 and the brushing water channel 14 are isolated from each other, and the eject water channel 12 is communicated with the drain outlet of the water tank 20, and the ring brushing is communicated with a independent water source.

The toilet body 10 and the water tank 20 can be formed in one piece, and the isolation between the eject water channel 12 and the brushing water channel 14 can be made directly during the above forming process.

A independent overflowing waterway is arranged on the toilet, the overflowing waterway and the eject water channel 12 are two independent channels that are not communicated with each other; the inlet of the overflowing waterway is arranged in the water tank 20, and the outlet of that is arranged to the toilet body 10, and the overflowing channel is formed and the overflowing water can flows into the urinal part of the toilet.

The inlet of the eject water channel 12 is under the drain valve 22, and the inlet of the brushing water channel 14 is arranged out of the space of the eject water channel 12, and one end of the connector assembly of the brushing water channel 14 is mounted in the inlet of the brushing water channel 14, another end is communicated with the outer supply waterway (not shown in figures).

Figure 10:
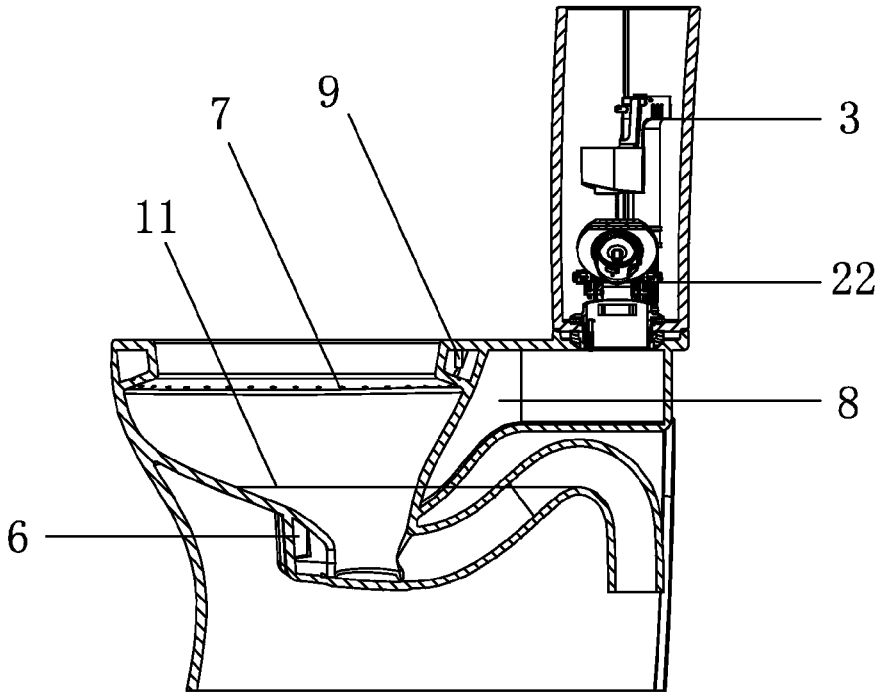
FIG. 10 shows the lengthwise sectional view of the eject water channel of the embodiment 5 of the water-saving siphon toilet in the present invention.
Figure 11:
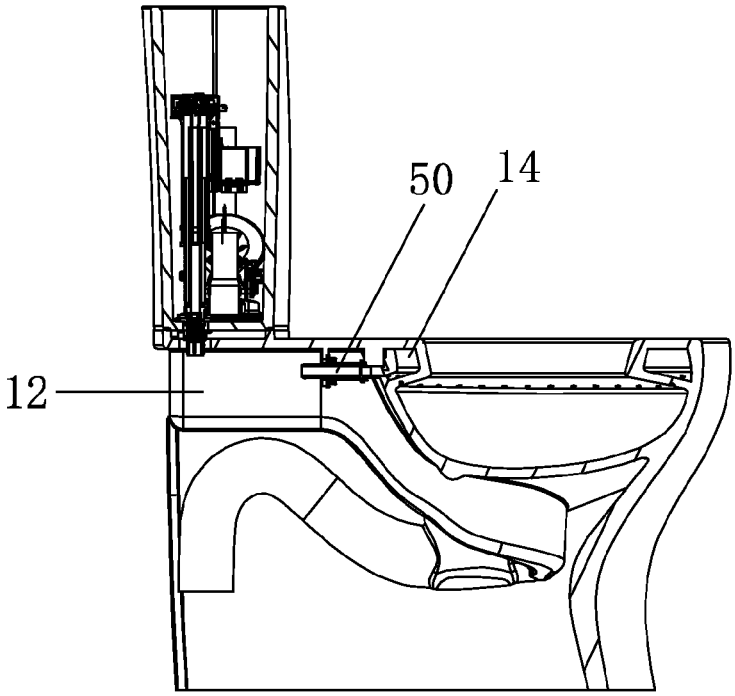
FIG. 11 shows the lengthwise sectional view of the brushing water channel of the embodiment 5 of the water-saving siphon toilet in the present invention.
Figure 12:
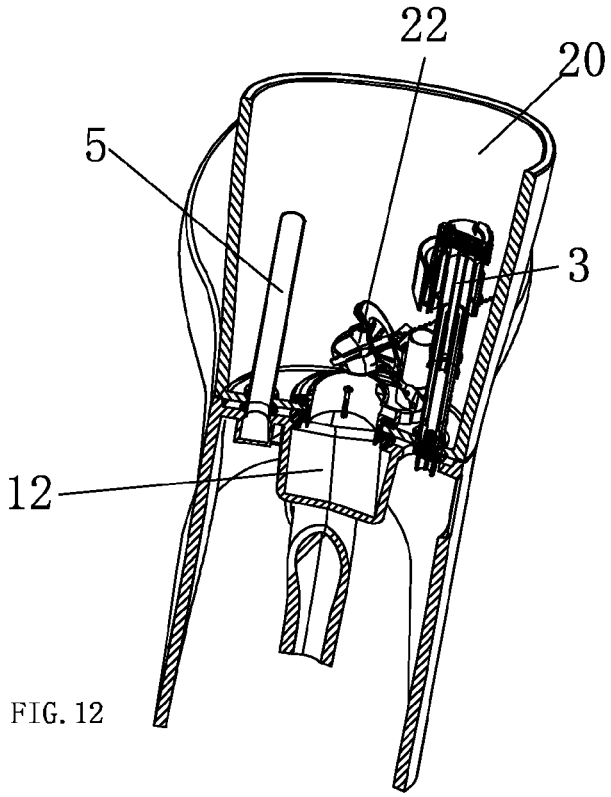
FIG. 12 shows the sectional view of the overflow supplying pipe of the embodiment 5 of the water-saving siphon toilet in the present invention.

As shown in FIG. 10, the overflowing waterway is isolated from the eject water channel 12 and communicated with the brushing water channel 14. Water flows over to the washable surface, and then to the pollution pipe from the brushing water channel 14 when the toilet is overflowing. If the toilet needs to be replenished, the replenishing waterway is arranged on the overflowing channel, and the water replenishing is achieved through the overflowing channel.

Figure 1:
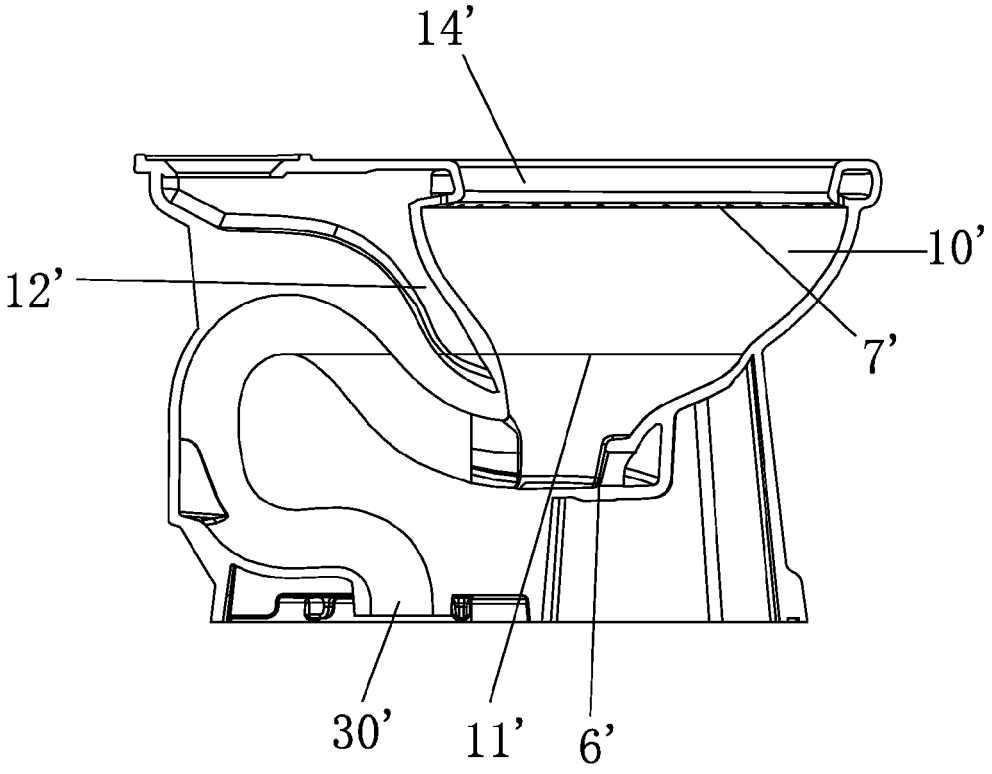
FIG. 1 shows the lengthwise sectional view of the traditional siphon toilet.
Figure 2:
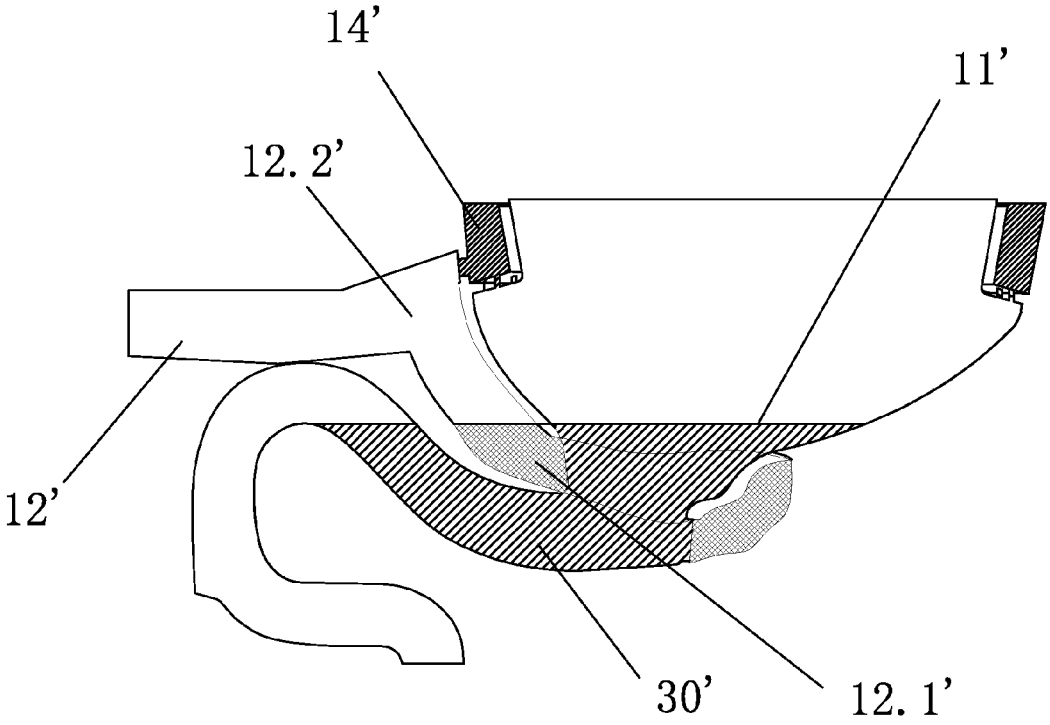
FIG. 2 shows the distribution of the water way and the air way in the traditional siphon toilet.

In the present embodiment, the opening of the brushing water channel 14 is arranged at the place shown in FIG. 2, namely at the back of the toilet body, and is paralleling to the inlet of the eject water channel 12. And it also can be arranged at any appropriate position of the ring.

Figure 9:
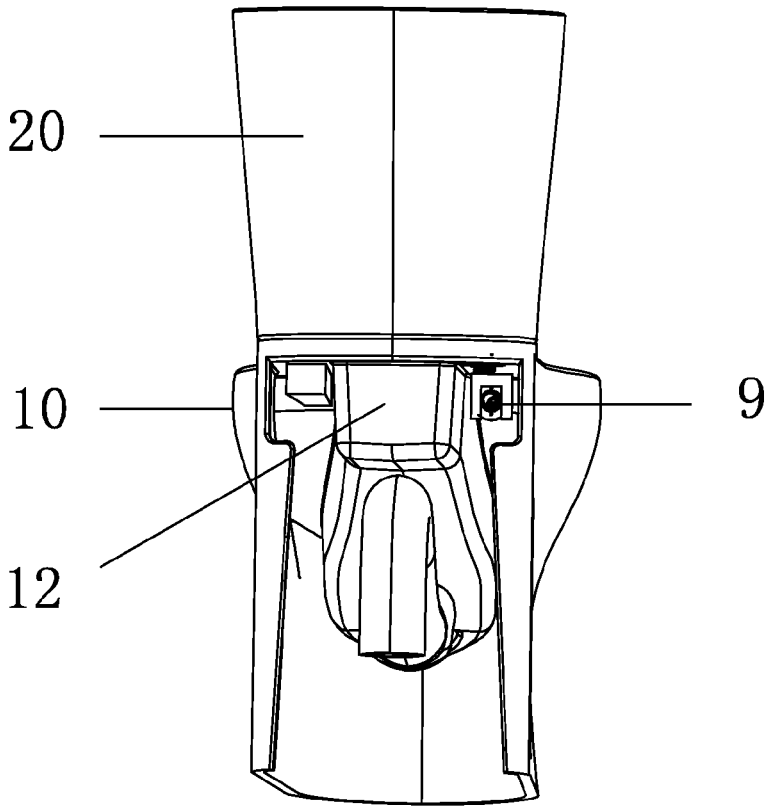
FIG. 9 shows the overall appearance view of the embodiment 5 of the water-saving siphon toilet in the present invention.

The independent water source in the present invention is a independent water tank with a valve, the draining outlet of the independent waterway is communicated with the said brushing water channel 14. As shown in FIG. 9, a sealed outer connector 50 is arranged at the opening of the brushing water channel 14. The outer connector 50 and the wall of the opening of the brushing water channel 14 fit closely to form a sealing installation.

The drain valve 4 is open when the first draining begins, the water from the water tank 20 of the toilet enters the eject water channel 12, and flushes the feculence in the toilet through the eject hole 6 of the eject water channel 12 and helps pollution pipe form siphon. Because the brushing water channel 14 is isolated from the eject water channel 12, the air on the flushing opening 7 of the brushing water channel 14 will not apply pressure to the eject water channel 12. After the drain valve is shut, the inlet of the eject water channel 12 is isolated from the outside air. The outlet of the eject water channel 12 is lower than the water surface. Therefore the whole eject water channel 12 is nearly filled with water under the atmosphere. And eject water channel 12 doesn't need to be filled with water again after the next draining, and water can be ejected out of the eject hole as soon as the drain valve 4 is opened to push the feculence and to fill up with the pollution pipe to form siphon. Therefore the siphon can be started earlier than the common toilet, and last longer than the common toilet, so the enhanced siphon effect is achieved.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

What is claimed is:

1. A siphon toilet, comprising:

a toilet body;

a water tank;

an eject water channel used for flushing a bottom of the toilet body, the eject water channel being arranged between the toilet body and the water tank;

a brushing water channel used for brushing a washable surface of the toilet body with water, the brushing water channel being arranged between the toilet body and the water tank; and a siphon channel used for removing pollution and being arranged at the bottom of the toilet body; and a first drain valve being arranged in the water tank;

a common channel under the first drain valve;

an isolating wall arranged at a position where the common channel protrudes towards the washable surface, the isolating wall isolating the brushing water channel from the eject water channel; and a check valve arranged on the isolating wall to be between the eject water channel and the brushing water channel, the check valve has a first state and a second state, in the first state the check valve is opened when the water tank is at a draining state, so that water flows through both the eject water channel and the brushing water channel, and in the second state the check valve is shut when the water tank is at a non-draining state, so that the eject water channel and the brushing water channel are hermetically isolated from each other, wherein when the brushing water channel is not brushing the washable surface, the check valve is in the second state and a water seal is formed by the siphon channel so that an inlet of the eject water channel is isolated from outside air, so that the outside air cannot be communicated to the inlet of the eject water channel, further wherein an upper end of an outlet of the eject water channel is lower than an upper part of the siphon channel, and further wherein, when the brushing water channel is not brushing the washable surface, reserved water is stored in the eject water channel for flushing the bottom of the toilet body at a next flushing time in which the toilet is flushed.

2. The siphon toilet according to claim 1, wherein, the check valve comprises:

a check valve body, an exit of the common channel is arranged at the check valve body; and a check valve plate having a fixed end and an unfixed end to be rotatable about one axis of the fixed end, the check valve plate being movable between different positions to open and close the exit;

wherein when draining of the water tank is started, water flows from the common channel to the brushing water channel so as to move the check valve plate such that the exit is opened by the check valve plate so that the check valve is in the first state;

further wherein when the draining of the water tank nearly ends, the check valve plate moves so that the exit is closed by the check valve plate so that the check valve is in the second state.

3. The siphon toilet according to claim 1, further comprising:

an overflow pipe arranged in the water tank;

wherein water enters the brushing water channel through the first drain valve, further wherein the overflow pipe is arranged on the first drain valve.

4. The siphon toilet according to claim 1, wherein, an overflow channel of the water tank is arranged out of the eject water channel and the common channel.

* * * * *